US010662032B2

(12) United States Patent
Hill et al.

(10) Patent No.: US 10,662,032 B2
(45) Date of Patent: May 26, 2020

(54) ELEVATOR DOOR HATCH

(71) Applicant: Cab Solutions, LLC, Feasterville, PA (US)

(72) Inventors: Gerald Hill, Bryn Athyn, PA (US); Stephen McDonald, Huntingdon Valley, PA (US)

(73) Assignee: CAB Solutions, LLC, Feasterville, PA (US)

( * ) Notice: Subject to any disclaimer, the term of this patent is extended or adjusted under 35 U.S.C. 154(b) by 360 days.

(21) Appl. No.: 15/663,972

(22) Filed: Jul. 31, 2017

(65) Prior Publication Data

US 2018/0105394 A1 Apr. 19, 2018

Related U.S. Application Data

(60) Provisional application No. 62/409,632, filed on Oct. 18, 2016.

(51) Int. Cl.

| | |
|---|---|
| ***B66B 11/02*** | (2006.01) |
| ***B66B 5/00*** | (2006.01) |
| ***B66B 13/24*** | (2006.01) |

(52) U.S. Cl.

CPC ..... *B66B 11/0226* (2013.01); *B66B 5/0087* (2013.01); *B66B 11/0233* (2013.01); *B66B 11/0246* (2013.01); *B66B 13/24* (2013.01)

(58) Field of Classification Search

CPC ..... B66B 11/0226; B66B 11/0233; B66B 11/0246

See application file for complete search history.

(56) References Cited

U.S. PATENT DOCUMENTS

| | | | | |
|---|---|---|---|---|
| 4,364,601 | A * | 12/1982 | Katayama | B60J 7/05 296/221 |
| 9,193,566 | B1 * | 11/2015 | Nieves | B66B 11/0226 |
| 2019/0031472 | A1 * | 1/2019 | Salin | B66B 11/0226 |
| 2019/0263629 | A1 * | 8/2019 | Fernandez | B66B 11/0246 |

FOREIGN PATENT DOCUMENTS

| | | | | |
|---|---|---|---|---|
| FR | 2942488 | A1 * | 8/2010 | E04B 9/003 |
| WO | WO-2009103861 | A1 * | 8/2009 | E04F 19/08 |

* cited by examiner

*Primary Examiner* — Diem M Tran

(74) *Attorney, Agent, or Firm* — Riverside Law LLP

(57) ABSTRACT

The present invention provides improved elevator door hatches. The elevator door hatches drop open into the elevator cab and slide at a desirable angle just underneath the elevator cab ceiling, without extending too far or too low into the interior cab space. The elevator door hatches are able to accommodate light fixtures and cabling installed into the elevator door hatches without disconnecting when the door hatches are slid underneath the elevator cab ceiling in the open position. The door hatch also allows for the drop ceiling to be mounted closer to the canopy, which increases the usable height of the elevator cab.

17 Claims, 10 Drawing Sheets

ELEVATOR DOOR HATCH

CROSS-REFERENCE TO RELATED APPLICATIONS

This application claims priority to U.S. Provisional Patent Application No. 62/409,632 filed Oct. 18, 2016, the contents of which are incorporated by reference herein in its entirety.

BACKGROUND OF THE INVENTION

Conventional elevator cabs are equipped with a door hatch in the car top for emergency access and rescue. When the car enclosure is equipped with a drop ceiling, this ceiling must also provide for a means of access that is in alignment with the door hatch in the car top. This means of access is presented in a variety of designs. For example, when a solid drop ceiling is present, a portion of that ceiling must be removable. Most commonly, this removable portion is lifted out of its position and stored in the cavity between the drop ceiling and the car top or removed entirely and stored on the car top. In any case, this removable portion must be properly secured so that it cannot inadvertently be released into the car enclosure. This design presents a number of drawbacks. When the removable portion of ceiling is stored in the cavity between the drop ceiling and car top, additional space is necessary to allow for the storage of the hatch. If the hatch is removed to the car top, it will also require a storage space which may be limited on the car top where personnel are also present. In both of these cases, the hatch is also susceptible to damage during storage. When lighting fixtures are present in the hatch, there are additional drawbacks of having to accommodate the lighting fixtures and associated wiring as well, often requiring that the lighting equipment be disconnected prior to removal. In some cases, it may be possible to hinge this removable portion either upwards or downwards. However, a number of conditions make this less common. In examples that are hinged upwards, the hatch must be smaller and aligned with the access panel in the car top. There normally exists a limitation to this due to the required minimal size of the opening. A downward hinged panel is normally limited by the requirement that when in the down position, the panel must be a minimum of 80 inches above the floor. While a hinged opening access door may avoid some of the drawbacks by eliminating the need to disconnect the lighting and wiring, the aesthetics of the interior of the elevator cab will suffer due to the obvious location of the access door.

Thus, there is a need in the art for improved elevator door hatches. The present invention meets this need.

SUMMARY OF THE INVENTION

In one aspect, the present invention relates to an elevator door hatch device adapted for an elevator ceiling comprising: a planar door panel; one or more extending slide rails attached to the door panel, each slide rail having a posterior end and an anterior end; a pivot hinge connecting the posterior end of each slide rail to an elevator ceiling; and a hinge bar connected at a first end to a hinge slot in the elevator ceiling by a sliding hinge, and connected at a second end to each slide rail by a rail hinge anterior to the pivot hinge.

In one embodiment, the one or more extending slide rail is a ball bearing rail. In one embodiment, the one or more extending slide rail is a roller bearing rail. In one embodiment, the one or more extending slide rail is a friction rail.

In one embodiment, the door panel rotates around the pivot hinge of each slide rail. In one embodiment, the pivot hinge comprises a mechanism for controlling the degree of rotation. In one embodiment, the rail hinge comprises a mechanism for controlling the degree of rotation. In one embodiment, the degree of rotation is limited by the length of the hinge bar. In one embodiment, the rotation of each slide rail is limited to a maximum angle of between 8 to 12 degrees from horizontal.

In one embodiment, the elevator ceiling is positioned below an elevator canopy. In one embodiment, the door panel comprises one or more lighting unit electrically connected to one or more lighting unit in the elevator ceiling. In one embodiment, the door panel rotates downwards and is movable along the one or more extending slide rail to slide below an adjacent panel of the elevator ceiling without removing the one or more lighting unit or disconnecting any electrical connections.

In one embodiment, the door panel further comprises an extended lip that engages the elevator ceiling to prevent rotational movement of the door panel. In one embodiment, shortening the one or more slide rail disengages the lip from the elevator ceiling. In one embodiment, the device further comprises one or more locking mechanisms to lock movement in the one or more slide rail. In one embodiment, the locking mechanism is a pin. In one embodiment, the pin is spring-loaded. In one embodiment, the locking mechanism is a crossbar lock.

In one embodiment, the device further comprises a handle. In one embodiment, the door panel is detachable from the one or more slide rail.

BRIEF DESCRIPTION OF THE DRAWINGS

The following detailed description of the invention will be better understood when read in conjunction with the appended drawings. It should be understood, however, that the invention is not limited to the precise arrangements and instrumentalities of the embodiments shown in the drawings.

DETAILED DESCRIPTION

Figure 1:
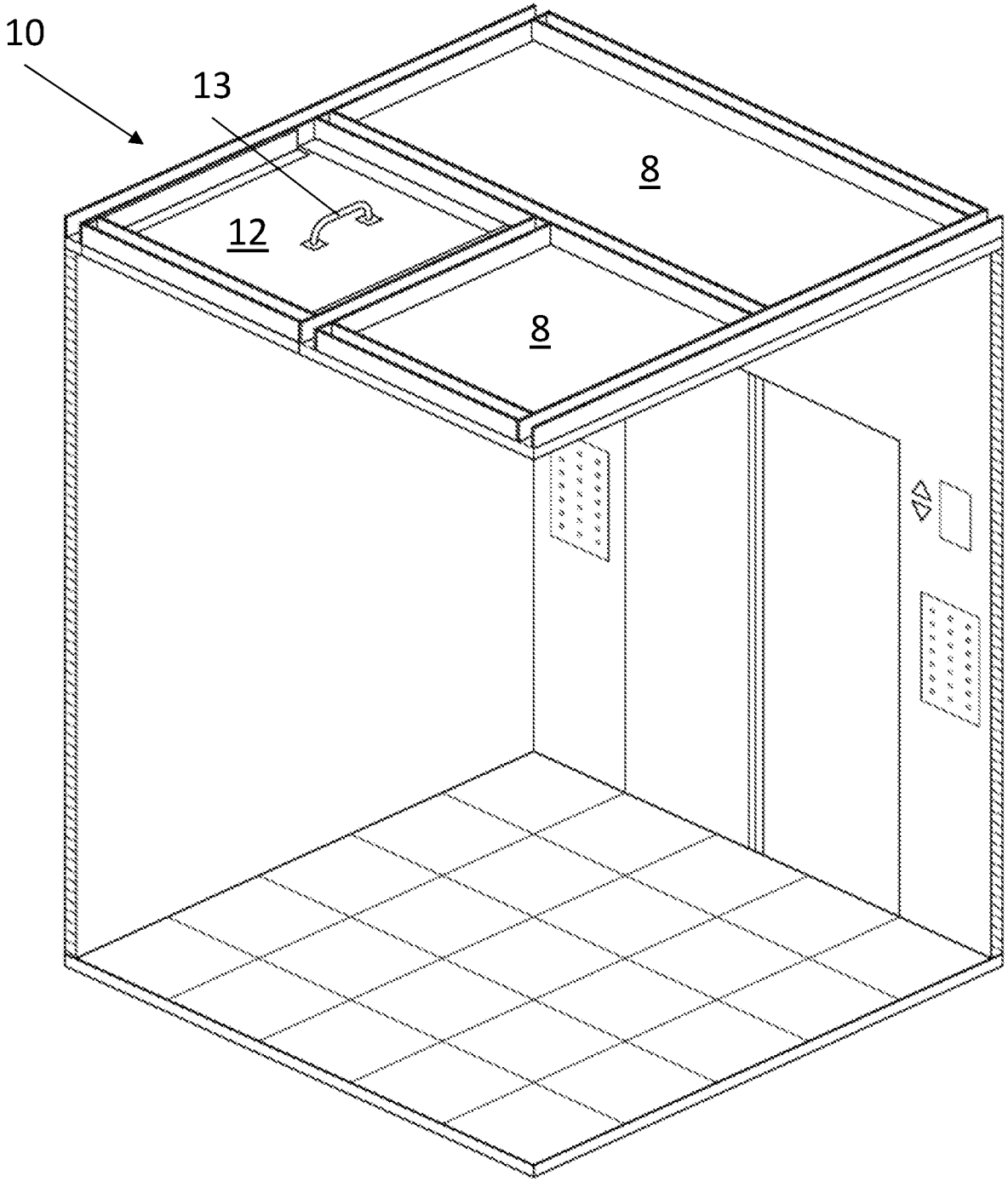
FIG. 1 depicts a perspective view of an exemplary elevator door hatch in the ceiling of an elevator cab.

The present invention provides improved elevator door hatches. The elevator door hatches drop open into the elevator cab and slide at a desirable angle just underneath the elevator cab ceiling, without extending too far or too low into the interior cab space. The elevator door hatches are able to accommodate light fixtures and cabling installed into the elevator door hatches without disconnecting when the door hatches are slid underneath the elevator cab ceiling in the open position. The door hatch also allows for the drop ceiling to be mounted closer to the canopy, which increases the usable height of the elevator cab.

Definitions

It is to be understood that the figures and descriptions of the present invention have been simplified to illustrate elements that are relevant for a clear understanding of the present invention, while eliminating, for the purpose of clarity, many other elements typically found in the art. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined elsewhere, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, 6, and any whole and partial increments there between. This applies regardless of the breadth of the range.

Elevator Door Hatch

The present invention provides improved elevator door hatches for emergency elevator cab access. The elevator door hatches open into the elevator cab for easy deployment. Instead of swinging downwards into the elevator cab space or lifted and stored above the cab space, the elevator door hatches ride a series of sliding rails at a desirable angle to slide underneath the elevator cab ceiling without endangering subjects standing within the cab.

Figure 2:
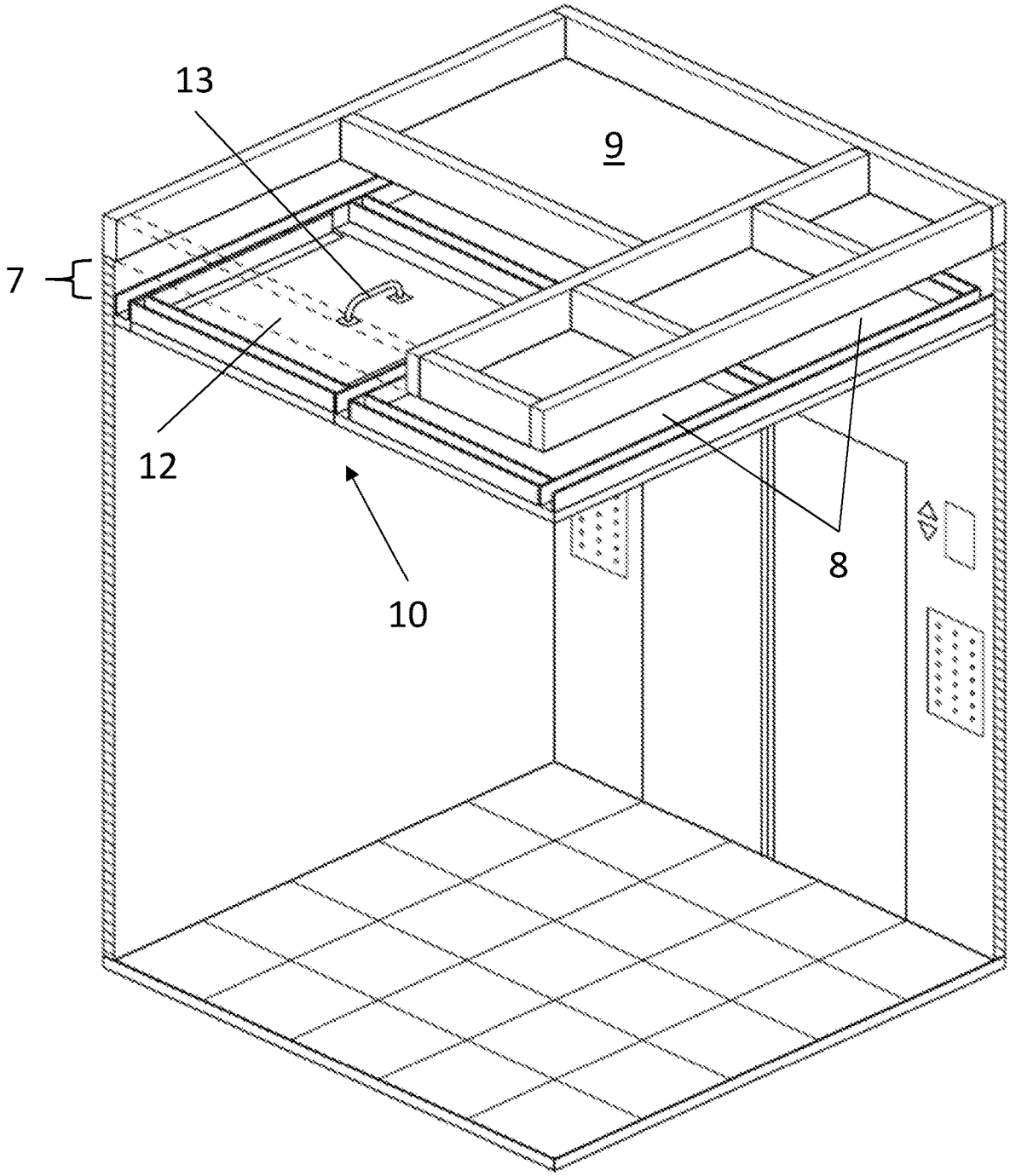
FIG. 2 depicts a perspective view of an exemplary elevator door hatch in a drop ceiling of an elevator cab.

Referring now to FIG. 1, an exemplary elevator door hatch 10 is depicted. Elevator door hatch 10 comprises door panel 12 positioned among the one or more elevator ceiling panel 8 to form an elevator ceiling. In some embodiments, elevator door hatch 10 comprises handle 13 for gripping elevator door hatch 10. In FIG. 2, door hatch 10 is depicted in a drop ceiling, wherein the drop ceiling is positioned below elevator canopy 9 with spacing 7 between the drop ceiling and elevator canopy 9. As will be apparent in the description of the present invention elsewhere herein, the function of elevator door hatch 10 is not impeded when placed in a drop ceiling due to the incorporation of slide rails and pivot hinges, which enables the drop ceiling to be installed underneath the elevator canopy at a reduced spacing 7.

Referring now to FIG. 3A, FIG. 3B, and FIG. 4A through FIG. 4C, side views of an exemplary elevator door hatch 10 are depicted. Elevator door hatch 10 further comprises extended lip 14, slot 15, slide rail 16, pivot hinge 17, hinge slot 19, sliding hinge 21, hinge bar 22, and rail hinge 23.

Elevator door hatch 10 is depicted as comprising door panel 12 adjustably positioned by movement along pivot hinge 17, slide rail 16, hinge slot 19 (visible in FIG. 4B, FIG. 4C), sliding hinge 21, hinge bar 22, and rail hinge 23. Door panel 12 is secured to one or more slide rail 16. Slide rail 16 can be any suitable track railing capable of extending and shortening, such as a ball bearing rail, a roller bearing rail, a friction rail, and the like. Each slide rail 16 is secured to a pivot hinge 17 at a posterior end and a hinge bar 22 at a position anterior to pivot hinge 17. Pivot hinge 17 secures the posterior end of slide rail 16 to the elevator cab ceiling. Pivot hinge 17 represents the center of rotation for elevator door hatch 10, wherein slide rail 16 and door panel 12 pivots around pivot hinge 17. Hinge bar 22 is connected at one end to hinge slot 19 in the elevator cab ceiling via sliding hinge 21, and is connected at the other end to sliding rail 16 via rail hinge 23. Hinge bar 22 aids in supporting the weight of elevator door hatch 10, while also limiting the degree of rotation of elevator door hatch 10 at pivot hinge 17. In various embodiments, one or more of pivot hinge 17, sliding hinge 21, and rail hinge 23 comprises a mechanism that limits the degree of rotation to provide additional control over the angle of deploying elevator door hatch 10. The mechanism can be a friction lock, a detent, a stepped mechanism, and the like.

Figure 3A:
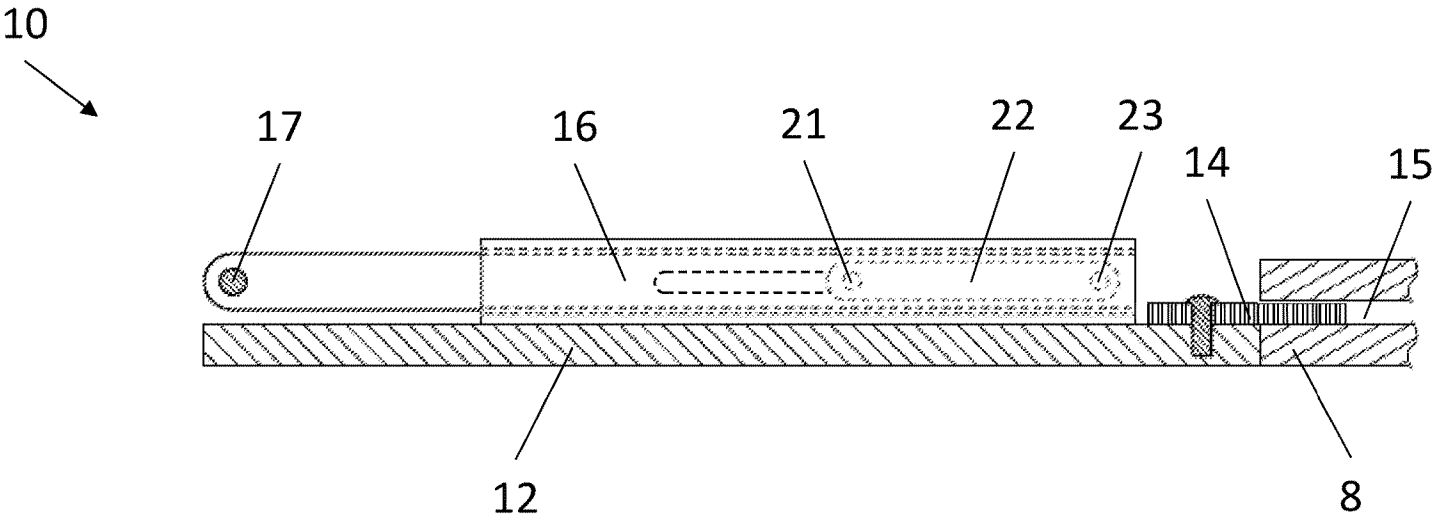
FIG. 3A and FIG. 3B depict side views of the slide rail and pivot hinge mechanism of an exemplary elevator door hatch.
Figure 3B:
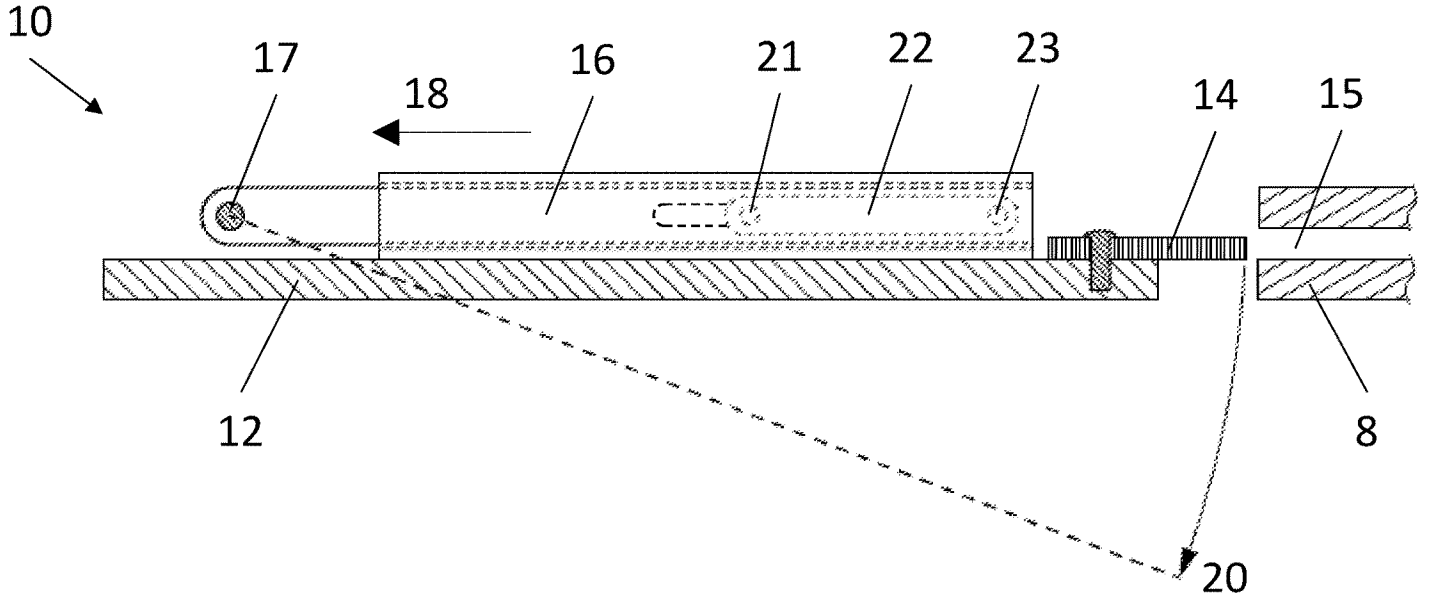

In FIG. 3A, elevator door hatch 10 engages an adjacent elevator ceiling panel 8 by the insertion of extended lip 14 into slot 15. Extended lip 14 is an overhanging flange or extension that rests on an adjacent elevator ceiling panel 8 to prevent elevator door hatch 10 from rotational movement. In some embodiments, an adjacent elevator ceiling panel 8 further comprises a slot 15 to receiving extended lip 14. In some embodiments, extended lip 14 may alternatively engage additional ceiling framing between door panel 12 and an adjacent ceiling panel 8, depending on the style and design of the elevator cab ceiling. In FIG. 3B, door panel 12 is shifted in a disengaging direction 18 to disengage extended lip 14 from an adjacent elevator ceiling panel 8, which allows elevator door hatch 10 to rotate. Slide rail 16 shortens, and sliding hinge 21 slides along hinge slot 19 (visible in FIG. 4B) to permit door panel 12 to be shifted in disengaging direction 18.

Figure 4A:
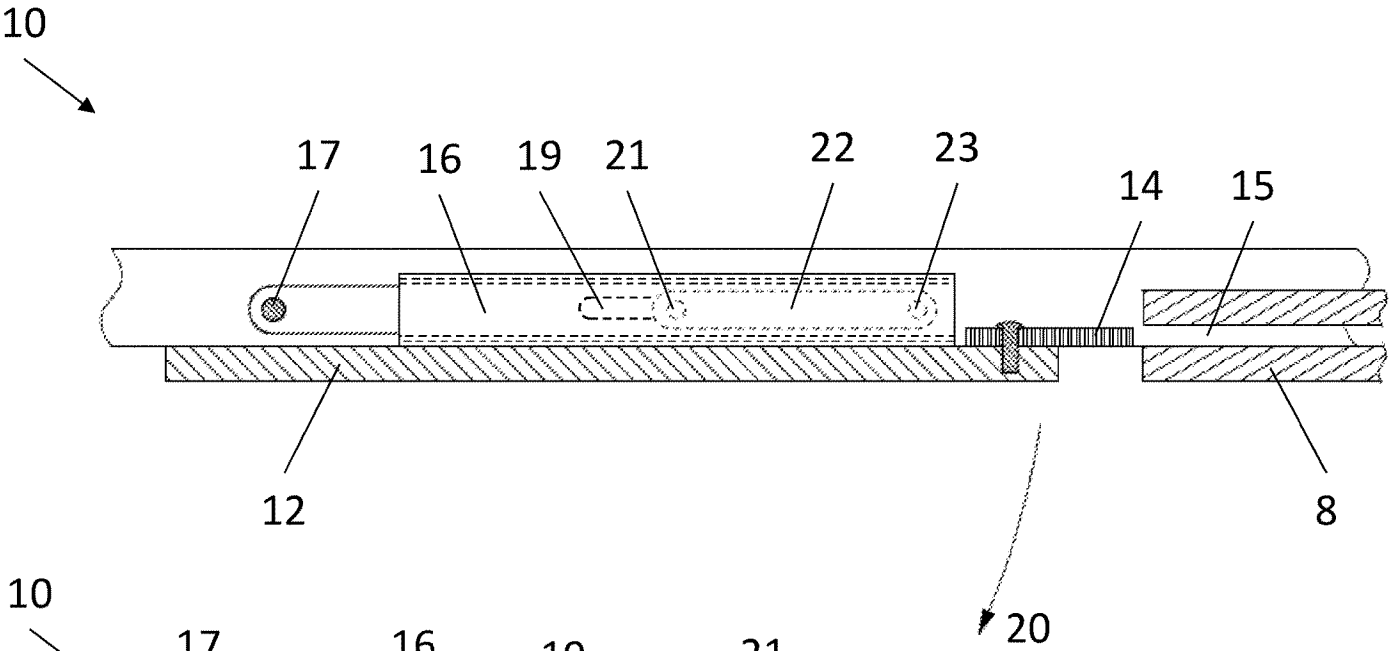
FIG. 4A through FIG. 4C depict side views of the slide rail, pivot hinge, and hinge bar mechanisms of an exemplary elevator door hatch in three stages of deployment.
Figure 4B:
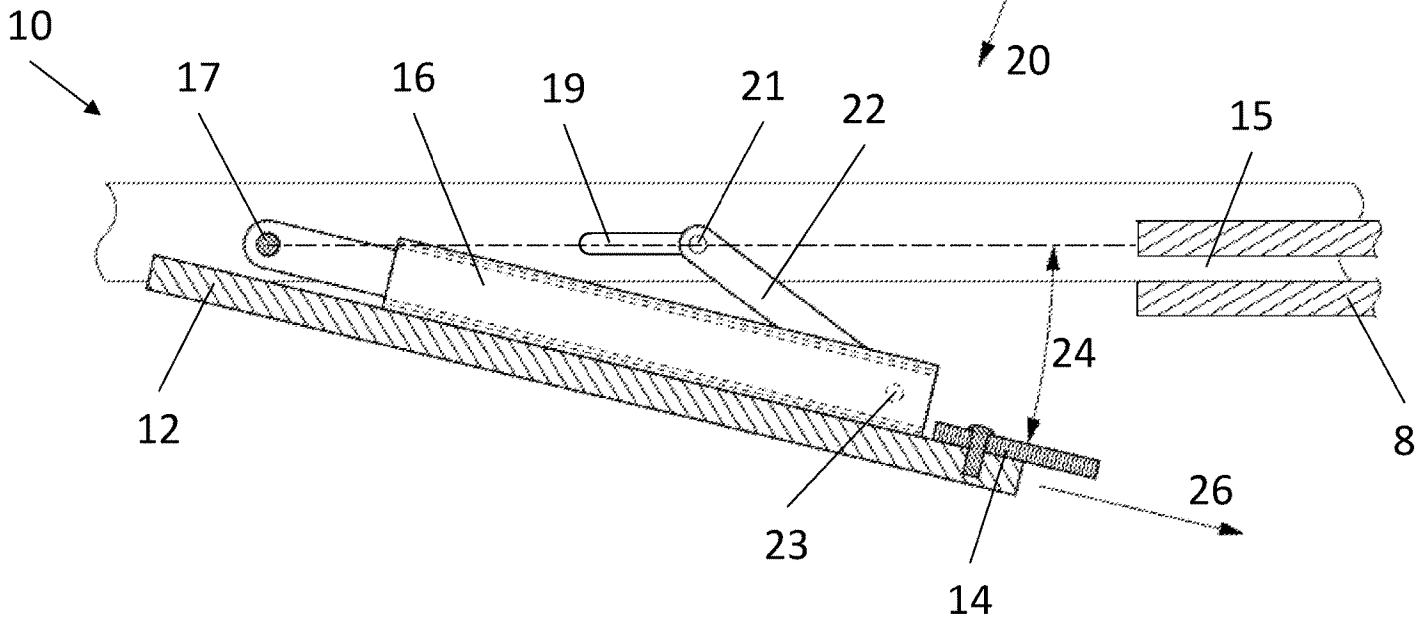
Figure 4C:
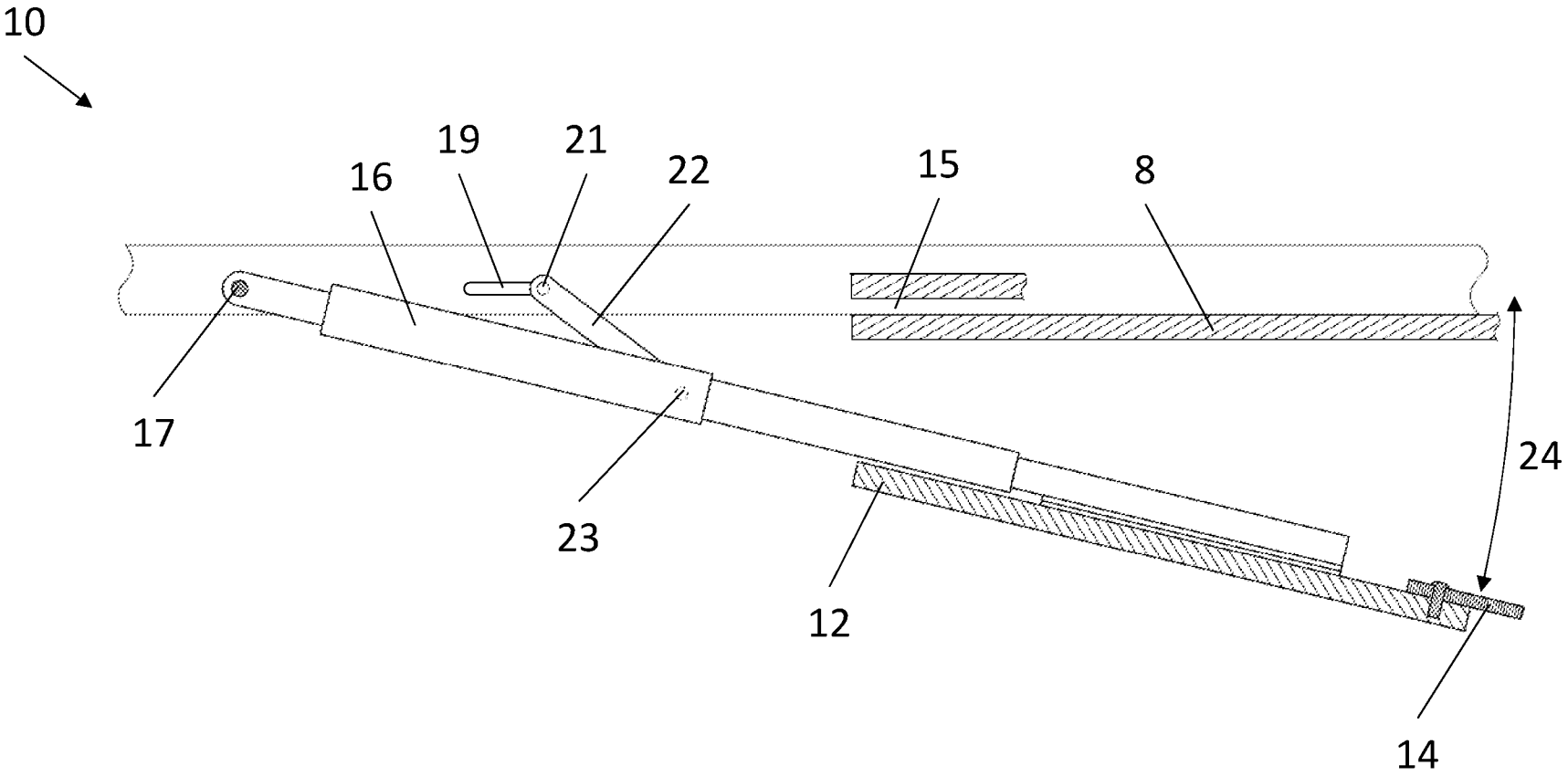

FIG. 4A through FIG. 4C depict the deployment of elevator door hatch 10 in sequence. In FIG. 4A, door panel 12 is in a disengaged position after being shifted in a posterior direction 18, shortening the one or more slide rail 16 and disengaging extended lip 14 from an adjacent elevator ceiling panel 8 (FIG. 3A, FIG. 3B). Disengaging extended lip 14 permits elevator door hatch 10 to pivot around pivot hinge 17 and rotate in a downwards direction 20. The motion of downwards direction 20 is guided by sliding hinge 21 and rail hinge 23, and the amount of rotation is limited by the position of sliding hinge 21 and rail hinge 23 and the length of hinge bar 22 to a maximum angle 24 (FIG. 4B). The maximum angle 24 can be any suitable angle measured from a horizontal elevator door hatch 10, such as an angle between 5 and 15 degrees, or between 8 and 12 degrees. Door panel 12 is then able to slide along the one or more slide rail 16 to extend in an anterior direction 26.

FIG. 4C depicts elevator door hatch 10 in a fully deployed position. The full extension of elevator door hatch 10 positions door panel 12 underneath an adjacent elevator ceiling panel 8. As is apparent in FIG. 4C, hinge bar 22 has limited the rotation of elevator door hatch 10 to a maximum angle 24 to prevent elevator door hatch 10 from descending any farther into the space of the elevator cab, avoiding unintended injury to any occupants present in the elevator cab.

Figure 5A:
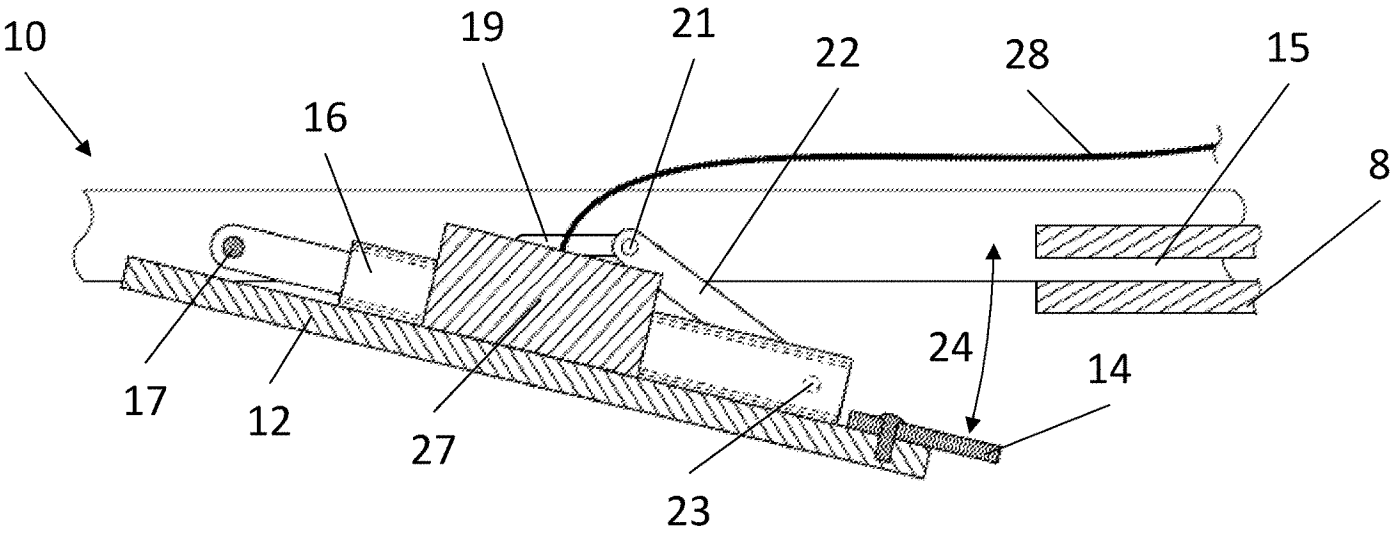
FIG. 5A through FIG. 5C depict side views of the slide rail, pivot hinge, and hinge bar mechanisms of an exemplary elevator door hatch with an installed light fixture and wiring in three stages of deployment.
Figure 5B:
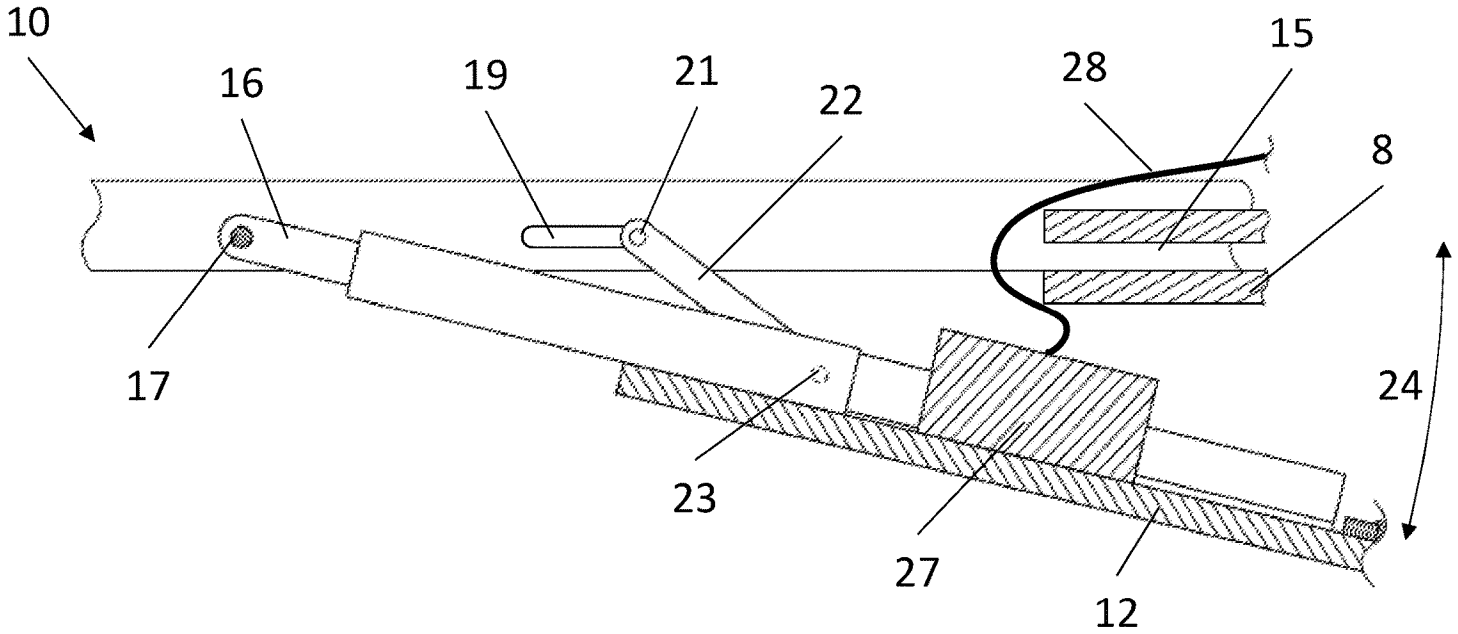
Figure 5C:
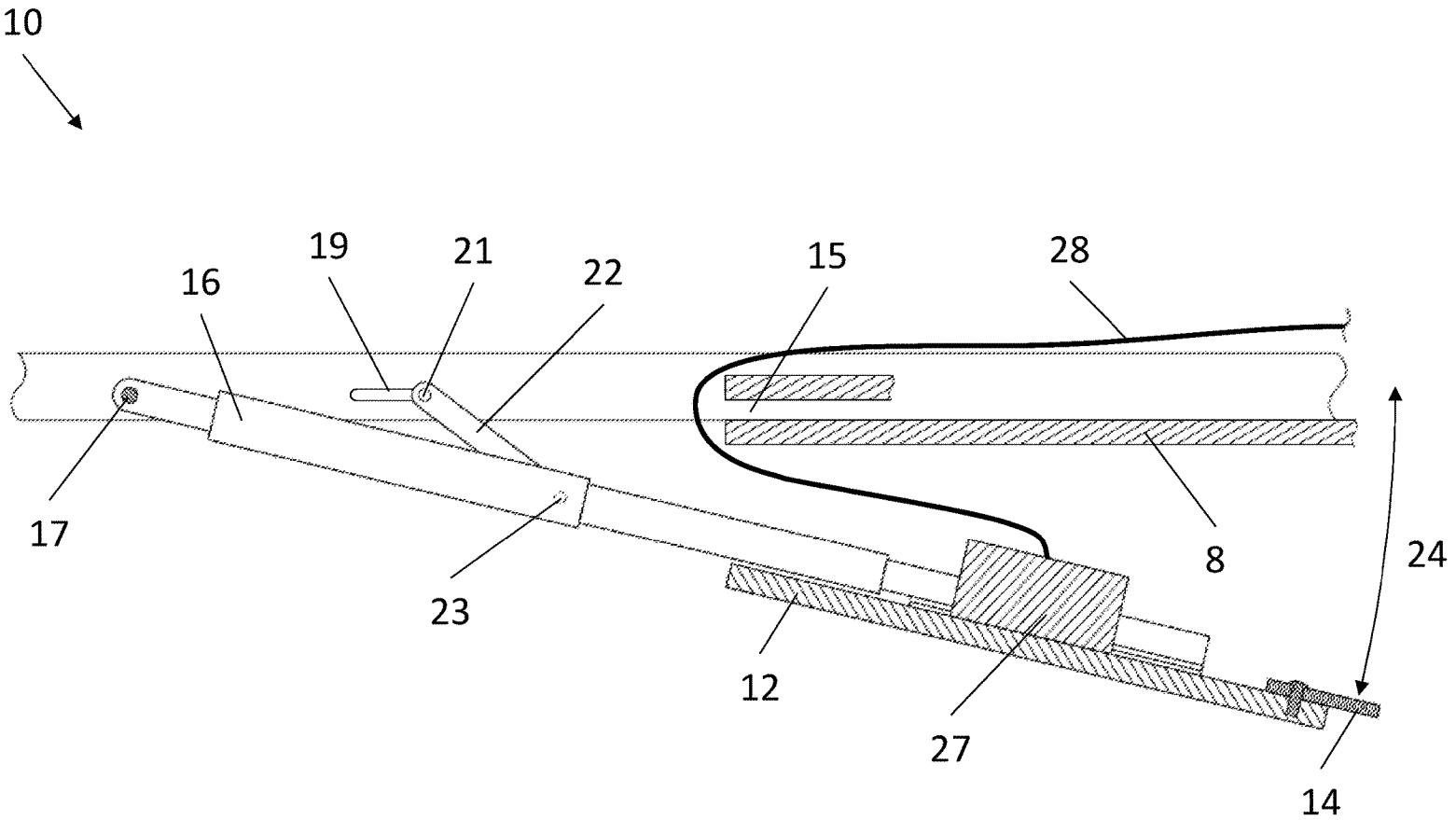

FIG. 5A through FIG. 5C depict the deployment of elevator door hatch 10 in sequence with lighting fixture 27 and wiring 28 attached. Throughout the entire sequence, maximum angle 24 permits sufficient clearance between door panel 12 and elevator ceiling panel 8 to accommodate the bulk of lighting fixture 27 and wiring 28. Thus, elevator door hatch 10 enables access to an elevator cab without the need to disconnect and remove components installed into door panel 12.

Figure 6A:
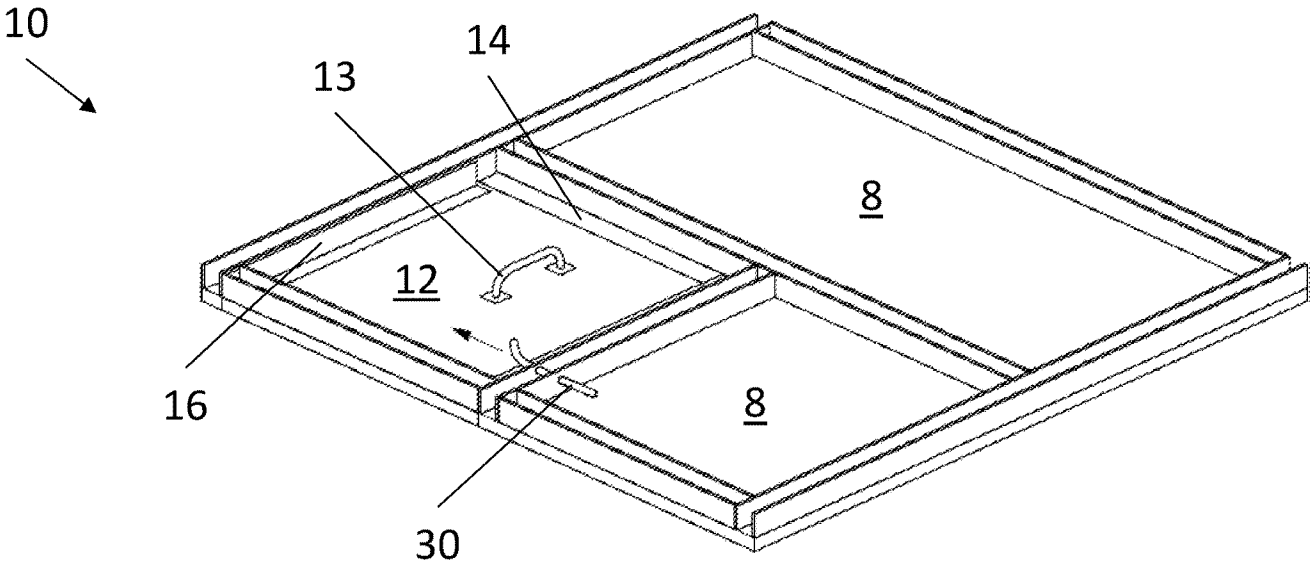
FIG. 6A and FIG. 6B depict perspective views of an exemplary elevator door hatch having a locking pin. (Lighting units not shown for better illustration of locking mechanism).
Figure 6B:
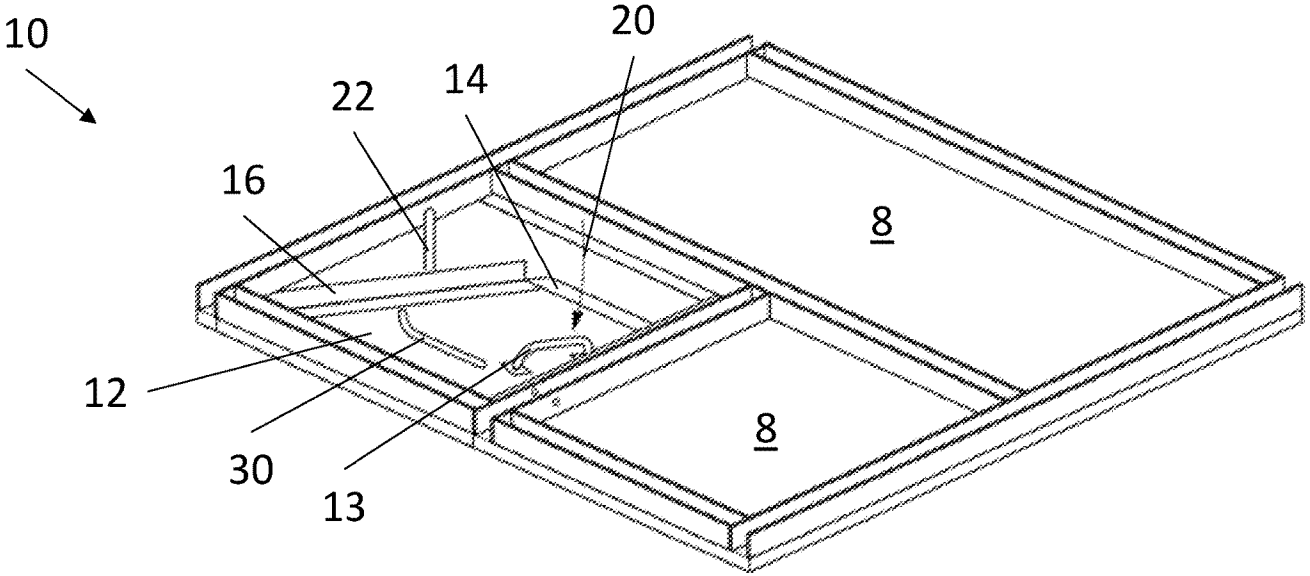

Referring now to FIG. 6A, FIG. 6B, FIG. 7A, FIG. 7B, FIG. 8A, and FIG. 8B, elevator door hatch 10 is depicted as further comprising one or more mechanisms for locking elevator door hatch 10 (lighting units not shown for better illustration of locking mechanisms. In one embodiment, elevator door hatch 10 is locked using one or more pin 30 (FIG. 6A and FIG. 6B). The one or more pin 30 engages elevator door hatch 10 and an adjacent elevator ceiling panel 8 or other ceiling framing to arrest all movement in elevator door hatch 10. In one embodiment, the one or more pin 30 may also engage one or more slide rail 16 to arrest all movement in elevator door hatch 10. Removing the one or more pin 30 unlocks and disengages elevator door hatch 10 from an adjacent elevator ceiling panel 8 or other ceiling framing, permitting elevator door hatch 10 to lower and deploy.

Figure 7A:
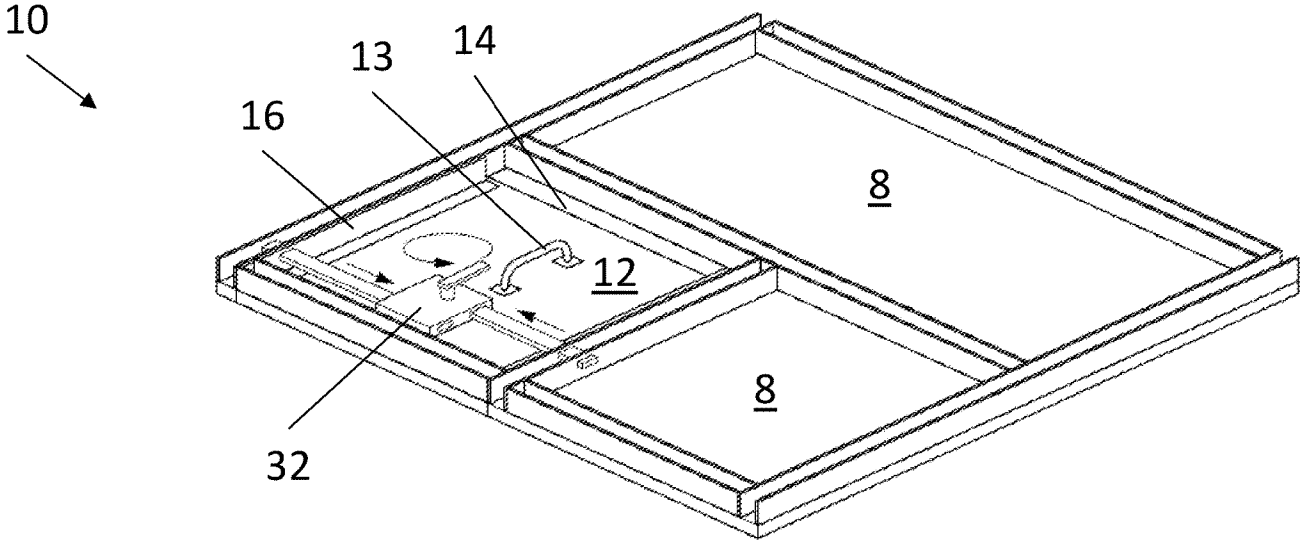
FIG. 7A and FIG. 7B depict perspective views of an exemplary elevator door hatch having a crossbar lock. (Lighting units not shown for better illustration of locking mechanism).
Figure 7B:
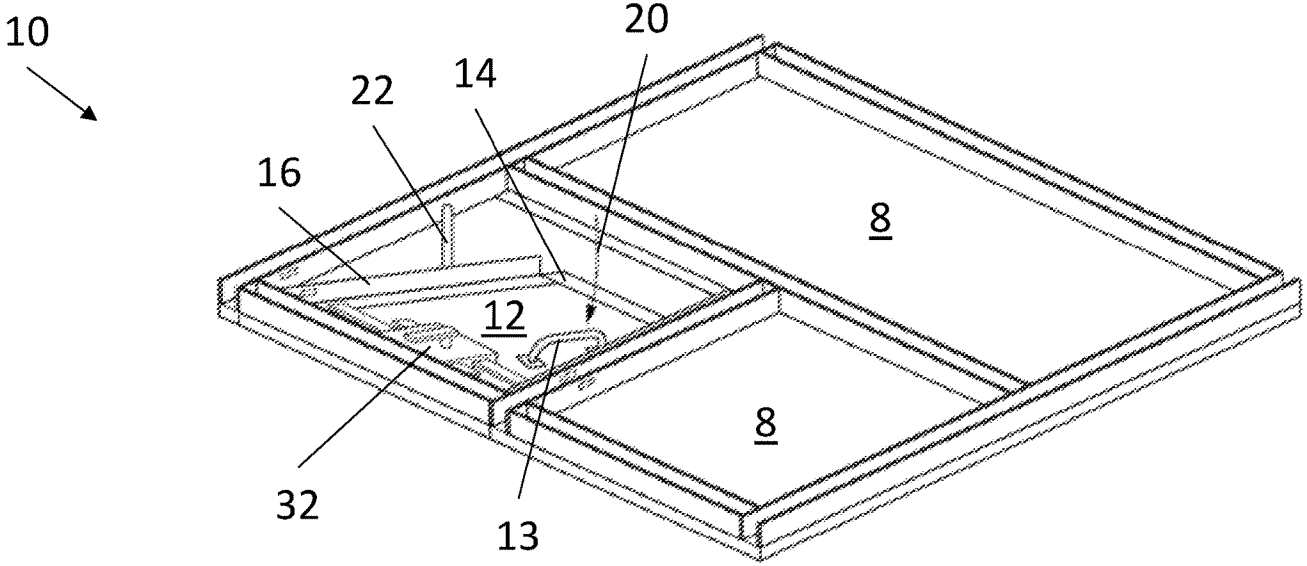

In another embodiment, elevator door hatch 10 is locked using crossbar lock 32 (FIG. 7A and FIG. 7B). Crossbar lock 32, comprising one or more crossbar, engages elevator door hatch 10 and one or more adjacent elevator ceiling panel 8 or other ceiling framing to arrest all movement in elevator door hatch 10. In one embodiment, crossbar lock 32 may also engage one or more slide rail 16 to arrest all movement in elevator door hatch 10. Actuating crossbar lock 32 retracts the one or more crossbar to unlock and disengage elevator door hatch 10 from the one or more adjacent ceiling panel 8 or other ceiling framing, permitting elevator door hatch 10 to lower and deploy.

Figure 8B:
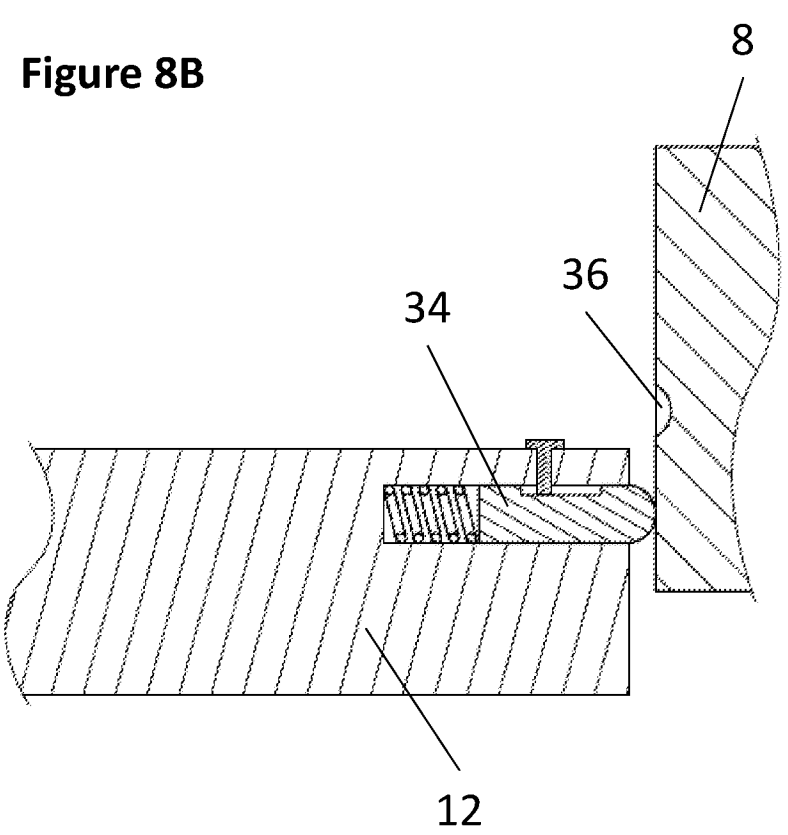
FIG. 8A and FIG. 8B depict side views of an exemplary elevator door hatch having a spring-loaded locking pin.
Figure 8A:
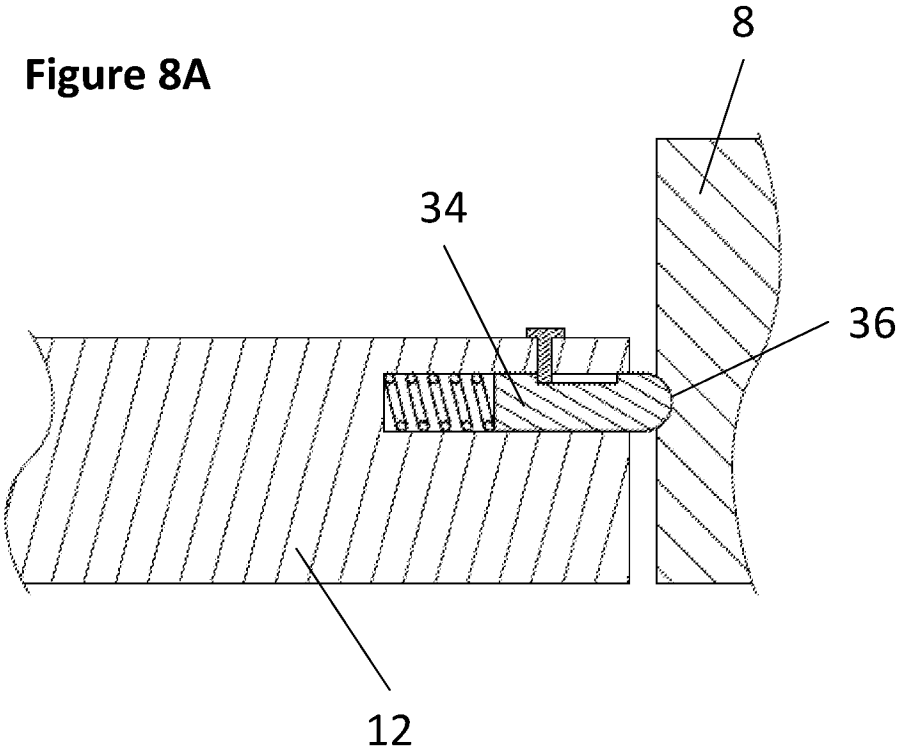

In another embodiment, elevator door hatch 10 is locked using one or more spring-loaded pin 34 (FIG. 8A and FIG. 8B). The one or more spring-loaded pin 34 sits within door panel 12, wherein the one or more spring-loaded pin 34 engages one or more pinhole 36 in an adjacent elevator ceiling panel 8 or other ceiling framing to arrest all movement in elevator door hatch 10. Retracting the one or more spring-loaded pin 34 from the one or more pinhole 36 unlocks and disengages elevator door hatch 10 from an adjacent elevator ceiling panel 8 or other ceiling framing, permitting elevator door hatch 10 to lower and deploy.

It should be appreciated that the elevator door hatches of the present invention are not limited solely to the embodiments depicted herein. Various embodiments not depicted in the Figures can include elevator door hatches further comprising one or more mechanisms that adapt the elevator door hatches to suit a particular purpose. In some embodiments, the elevator door hatches open upwards out of the elevator cab space. In some embodiments, the elevator door hatches are openable in either a downwards direction or an upwards direction. In some embodiments, the elevator door hatches allow door panel 12 to be detachable from an elevator ceiling. For example, a door panel 12 may be detachable at pivot hinge 17, hinge bar 22, slide rail 16, or combinations thereof. In some embodiments, the length or position of hinge bar 22 is adjustable to vary the degree of rotation around pivot hinge 17.

The elevator door hatches of the present invention can be made using any suitable materials and methods known in the art. The methods may vary depending on the materials used. For example, components substantially comprising wood may be cut to shape or formed from compressed wood material, while components substantially comprising a plastic or polymer may be milled from a large block or injection molded. Likewise, components substantially comprising a metal may be milled, cast, etched, or deposited by standard techniques commonly used in the art.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. An elevator door hatch device adapted for an elevator ceiling comprising:

a planar door panel;

one or more telescopically extending slide rail attached to the door panel, each slide rail having a posterior end and an anterior end;

a pivot hinge connecting the posterior end of each slide rail to a fixed hinging point on an elevator ceiling, such that the pivot hinge permits rotational movement only; and a hinge bar connected at a first end to a hinge slot in the elevator ceiling by a sliding hinge, and connected at a second end to each slide rail by a rail hinge anterior to the pivot hinge.

2. The device of claim 1, wherein the door panel rotates around the pivot hinge of each slide rail.

3. The device of claim 2, wherein the pivot hinge comprises a mechanism for controlling the degree of rotation.

4. The device of claim 2, wherein the rail hinge comprises a mechanism for controlling the degree of rotation.

5. The device of claim 2, wherein the door panel has a degree of rotation that is limited by a length of the hinge bar.

6. The device of claim 2, wherein the rotation of each slide rail is limited to a maximum angle of between 8 and 12 degrees from horizontal.

7. The device of claim 1, wherein the elevator ceiling is positioned below an elevator canopy.

8. The device of claim 1, wherein the door panel comprises one or more first lighting units electrically connected to one or more second lighting units in the elevator ceiling.

9. The device of claim 8, wherein the door panel rotates downwards and is movable along the one or more telescopic slide rail to slide below an adjacent panel of the elevator ceiling without removing the one or more first lighting units or disconnecting any electrical connections.

10. The device of claim 1, further comprising an extended lip that engages the elevator ceiling to prevent rotational movement of the door panel.

11. The device of claim 10, wherein shortening the one or more slide rail disengages the lip from the elevator ceiling.

12. The device of claim 11, further comprising one or more locking mechanisms to lock movement in the one or more slide rail.

13. The device of claim 12, wherein the locking mechanism is a pin.

14. The device of claim 13, wherein the pin is spring-loaded.

15. The device of claim 12, wherein the locking mechanism is a crossbar lock.

16. The device of claim 1, further comprising a handle.

17. The device of claim 1, wherein the door panel is detachable from the one or more slide rail.

* * * * *